US008974566B2

(12) United States Patent
Sauer et al.

(10) Patent No.: US 8,974,566 B2
(45) Date of Patent: Mar. 10, 2015

(54) VACUUM CLEANER FILTER BAG HAVING A SIDE FOLD

(75) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 207 days.

(21) Appl. No.: 13/579,227

(22) PCT Filed: Feb. 16, 2011

(86) PCT No.: PCT/EP2011/000732

§ 371 (c)(1),
(2), (4) Date: Oct. 30, 2012

(87) PCT Pub. No.: WO2011/101124

PCT Pub. Date: Aug. 25, 2011

(65) Prior Publication Data

US 2013/0036717 A1 Feb. 14, 2013

(30) Foreign Application Priority Data

Feb. 19, 2010 (EP) ..... 10001717

(51) Int. Cl.
*A47L 9/14* (2006.01)
*B31B 41/00* (2006.01)

(52) U.S. Cl.
CPC . *A47L 9/14* (2013.01); *B31B 41/00* (2013.01); *B31B 2219/148* (2013.01); *B31B 2219/2681* (2013.01); *B31B 2237/40* (2013.01); *B31B 2241/008* (2013.01); *Y10S 55/02* (2013.01); *Y10S 55/05* (2013.01); *Y10S 15/08* (2013.01)
USPC ..... 55/381; 55/382; 55/DIG. 2; 55/DIG. 5; 15/347; 15/DIG. 8; 156/199; 156/200; 156/201; 156/202; 156/203

(58) Field of Classification Search
USPC ..... 55/381, 382, DIG. 2, DIG. 5; 15/347, 15/DIG. 8; 156/199, 200, 201, 202, 203
See application file for complete search history.

(56) References Cited

U.S. PATENT DOCUMENTS

| | | | | |
|---|---|---|---|---|
| 6,379,409 | B1 | 4/2002 | Dijkman | |
| 6,514,325 | B2 * | 2/2003 | Cox et al. | 96/69 |
| 7,611,555 | B2 * | 11/2009 | Wattenberg et al. | 55/369 |
| 8,002,862 | B2 * | 8/2011 | Schultink | 55/367 |

(Continued)

FOREIGN PATENT DOCUMENTS

| | | | |
|---|---|---|---|
| DE | 20 2005 000 917 | U1 | 4/2005 |
| DE | 20 2005 000 918 | U1 | 5/2005 |

(Continued)

OTHER PUBLICATIONS

International Search Report completed Mar. 21, 2011 for International Application No. PCT/EP2011/000732.

*Primary Examiner* — Duane Smith
*Assistant Examiner* — Minh-Chau Pham
(74) *Attorney, Agent, or Firm* — Brinks Gilson & Lione

(57) ABSTRACT

A vacuum cleaner filter bag is provided. The vacuum cleaner filter bag includes at least one side fold formed by two fold legs, and the vacuum cleaner filter bag is designed as a tubular bag, wherein, in a turned-in state, the at least one side fold has at least three edges, wherein two of the edges are formed by a respective weld seam, and wherein the side fold can be turned out with the edges formed by a weld seam.

15 Claims, 5 Drawing Sheets

(56) References Cited

U.S. PATENT DOCUMENTS

| | | | | |
|---|---|---|---|---|
| 8,052,769 | B2 * | 11/2011 | Schultink et al. | 55/382 |
| 8,097,054 | B2 * | 1/2012 | Schultink et al. | 55/381 |

FOREIGN PATENT DOCUMENTS

| | | | | | |
|---|---|---|---|---|---|
| DE | 20 2005 016 309 | U1 | | 1/2006 | |
| DE | 20 2007 000 198 | U1 | | 4/2007 | |
| DE | 10 2007 005 612 | A1 | | 8/2007 | |
| DE | 10 2006 023 707 | B3 | | 1/2008 | |
| DE | 20 2007 017 064 | U1 | | 4/2008 | |
| DE | 20 2009 004 433 | U1 | | 7/2009 | |
| DE | 10 2008 006 769 | A1 | | 8/2009 | |
| DE | 20 2009 012 839 | U1 | | 1/2010 | |
| EP | 0 161 790 | A2 | | 11/1985 | |
| EP | 0 639 061 | B1 | | 5/1997 | |
| EP | 1 059 056 | A1 | | 12/2000 | |
| EP | 1 661 500 | A1 | | 5/2006 | |
| EP | 1 677 660 | | | 7/2006 | |
| EP | 1683460 | | * | 7/2006 | 55/DIG. 2 |
| WO | WO 00/64320 | A1 | | 11/2000 | |
| WO | WO 2007/073889 | A1 | | 7/2007 | |

* cited by examiner

VACUUM CLEANER FILTER BAG HAVING A SIDE FOLD

This application claims the benefit under 35 U.S.C. §371 of International Application No. PCT/EP2011/000732, filed Feb. 16, 2011, which claims the benefit of European Patent Application No. 10001717.7, filed Feb. 19, 2010, which are incorporated by reference herein in their entirety.

The invention relates to a vacuum cleaner filer bag having at least one side fold formed by two fold legs.

Vacuum cleaner filter bags are often made of non-wovens. Thanks to their excellent dust storage capacity, vacuum cleaner filter bags of non-wovens have practically replaced paper filter bags. The manufacture of the bags from non-wovens basically differs from the manufacture of paper bags. At present, rectangular flat bags formed by an upper and lower layers and circumferentially welded at the border are common. Such filter bags are known, for example, from EP 0 161 790, EP 0 639 061, EP 1 059 056, or EP 1 661 500.

To obtain a larger filling volume, compared to a pure flat bag with a simultaneously small pack size, flat bags with a surrounding weld seam and side folds that can be turned out are used. Such filter bags are known, for example, from DE 20 2005 000 918. Flat bags with side folds are also known from DE 10 2008 006 769, DE 20 2009 012 839, or DE 10 2006 023 707.

Apart from flat bags, sometimes block bottom bags are also used. The manufacture of block bottom bags from non-woven is complicated. Block bottom bags are known, for example, from DE 20 2005 016 309, DE 20 2007 000 198, DE 20 2007 017 064, DE 20 2009 004 433, or EP 1 677 660.

It is the object of the present invention to avoid disadvantages of known vacuum cleaner filter bags, in particular to provide a vacuum cleaner filter bag that is inexpensive and can be manufactured in a simple manner.

The invention provides a vacuum cleaner filter bag. In particular, a vacuum cleaner filter bag with at least one side fold formed by two fold legs is provided, the vacuum cleaner filter bag being designed as a tubular bag, wherein the at least one side fold comprises, in a turned-in state, at least three edges, wherein two of the edges are formed by one weld seam each, and wherein the side fold can be turned out with the edges formed by a weld seam.

By the vacuum cleaner filter bag being designed as a tubular bag, the vacuum cleaner filter bag can be manufactured in a cheaper and simpler manner than known vacuum cleaner filter bags of an upper and lower layer circumferentially welded to each other. In particular, additional efforts for double unwinding, continuous path control, welding and changing the reel, arising in the production from two circumferentially welded layers, can be eliminated.

The vacuum cleaner filter bag can comprise a bag wall. The bag wall can be made of a filter material layer, wherein two in particular opposed edges of the filter material layer are connected thus forming a tube. By closing the open ends of the tube by transverse seam welds, one obtains a tubular bag. The connection of the edges in the formation of the tube, and/or the closing of the open ends of the tube can be done by ultrasonic welding and/or by thermal welding.

The side fold can be arranged at one side of the vacuum cleaner filter bag, in particular at a side of the vacuum cleaner filter bag that is not completely formed by a weld seam.

The side fold can correspond to an inward folding of the vacuum cleaner filter bag, in particular an inward folding of the bag wall of the vacuum cleaner filter bag. In particular, parts of the bag wall of the vacuum cleaner filter bag can be folded inwards to the interior of the vacuum cleaner filter bag, while two fold legs are formed.

This means, the side fold comprises two fold legs, at least three edges being formed by them being connected. Two of the edges are formed by one weld seam each. The edges formed by weld seams can in particular be opposed edges.

In other words, the fold legs can correspond to subareas of the bag wall of the vacuum cleaner filter bag which, in a turned-in state of the side fold, are arranged between, i.e. overlapping with, other parts of the bag wall or bordered by parts of the bag wall.

Parts of the bag wall can form a front wall and a parallel rear wall, at least one side wall being formed between the front wall and the rear wall by the at least one side fold.

The at least one side fold can assume at least two states, which are a turned-in or folded-in state in which the fold legs are arranged with the edges of the fold legs between other parts of the bag wall, and a turned-out or folded-out state in which the fold legs are not arranged with the edges of the fold legs between other parts of the bag wall. The side fold can also assume a partly turned-out or folded-out state in which the fold legs are only partly arranged with the edges of the fold legs between other parts of the bag wall.

In the turned-out state, the fold legs of the turned-out side fold can form lateral broadenings of the front wall and the rear wall.

The turned-in state can be used before the vacuum cleaner filter bag is used to permit an easy insertion of the vacuum cleaner filter bag into a vacuum cleaner. The turned-out state can be used in the operation of the vacuum cleaner filter bag in a vacuum cleaner to enlarge the available filling volume. Depending on the available interior of the vacuum cleaner housing, in the operation of the vacuum cleaner filter bag, the side fold can also be only partly turned out.

"Turn out" means that the side fold is designed such that it can be brought from the turned-in to the turned-out state, in particular by folding or turning out the side fold. The side fold can be turned out in particular by a pressure differential between the interior and the exterior of the vacuum cleaner filter bag generated in the vacuum cleaner housing.

The side fold can be turned out in particular together with the edges formed by a weld seam. In other words, the side fold can be completely turned out.

The edges formed by weld seams can, in a turned-in or folded-in state of the side fold, face or extend to the inside, that means to the interior of the bag, where the side fold can be turned out such that the fold legs and the edges formed by weld seams face or extend, in a turned-out or folded-out state of the side fold, to the outside, that means not to the interior of the bag.

The side fold can be turned out across the complete width of the side of the vacuum cleaner filter bag where the side fold is arranged.

A first side, in particular a first longitudinal side, of the vacuum cleaner filter bag can be formed by a first transverse weld seam, and a second opposite side, in particular a second longitudinal side, of the vacuum cleaner filter bag can be formed by a second transverse weld seam. An edge of the at least one side fold formed by a weld seam can be adjacent to the first transverse weld seam, and the second edge of the at least one side fold formed by a weld seam can be adjacent to the second transverse weld seam. The edges of the at least one side fold formed by a weld seam can be partially, in particular at one end, connected to the respective transverse weld seam.

In the turned-in state, the edges of the at least one side fold formed by weld seams can include, with the transverse weld seams, each an angle greater than 0° and smaller than 90°, in particular greater than 10°, 20° or 30°, and smaller than 80°, 70° or 60°. In other words, the edges of the at least one side fold formed by weld seams and the respective transverse weld seams can include an acute angle.

The angle can here be measured from the respective transverse weld seam in the direction towards the interior of the vacuum cleaner filter bag. If the edges formed by weld seams do not extend in a straight line, the angle between the respective transverse weld seam and a straight line formed by the connecting line between the end points of the edges formed by weld seams can be measured. As an alternative, the angle between the respective transverse weld seam and a central tangent line at the respective edge of the side fold formed by a weld seam can be measured. As the central tangent line, one can use a tangent line at the center between the two end points of an edge formed by weld seams.

The edges formed by weld seams can be embodied to be movable relative to the transverse weld seams. In particular, the edges formed by weld seams can be movable such that the angle between the edges formed by weld seams and the respective transverse weld seam can be changed. In particular, in a turned-out or folded-out state of the side fold, the angle between the respective transverse weld seam and the corresponding edge of the at least one side fold formed by a weld seam can be greater than 90° and smaller than 180°, in particular greater than 100°, 110° or 120°, and smaller than 150°, 160° or 170°, in particular measured from the transverse weld seam in the direction of the interior of the vacuum cleaner filter bag.

The edges of the at least one side fold formed by weld seams can be straight and/or curved. For example, both edges formed by weld seams can be straight, both can be curved, or one of the two edges can be straight and the other edge can be curved. Moreover, one or both of the edges formed by weld seams can be partially straight and partially curved. Due to the fact that the edges of the side fold formed by weld seams can have different shapes or geometries, the folded-out or turned-out state of the side fold that is present in the operation of a vacuum cleaner can be adapted to the available interior of the vacuum cleaner housing.

The edges formed by weld seams can have different lengths. By this, they can be further adapted to the available interior of the vacuum cleaner housing.

The edges of the at least one side fold formed by weld seams can be designed such that they are not connected and/or welded to the bag wall, in particular inside the vacuum cleaner filter bag. The edges of the at least one side fold formed by weld seams, however, can be connected with one transverse weld seam each, that means be adjacent to a transverse weld seam.

One of the edges of the at least one side fold, in particular an edge between the two edges formed by weld seams, can be designed such that it is not formed by a weld seam. In particular, the at least one side fold can comprise exactly three edges. With three edges, for example the central edge can be designed such that it is not formed by a weld seam.

In particular, one edge of the at least one side fold can be formed by a fold line. By this, the bag can be better adapted to the interior of the vacuum cleaner housing. In particular, a side fold formed by a fold line can be softer and more flexible than an edge formed by a weld seam. By this, the folding out of the side fold can be improved, and an improved adaptation of the bag to the shape of the vacuum cleaner can be achieved.

The edge of the at least one side fold which is not formed by a weld seam can in particular be longer than the edges formed by a weld seam.

The vacuum cleaner filter bag can have two side folds, in particular at opposite sides of the vacuum cleaner filter bag. By this, a further enlargement of the filling volume can be achieved.

The two side folds can be in particular identical or non-identical. For example, one of the side folds can, in a folded-in state, project further into the bag's interior than the second side fold. As an alternative or in addition, the edges of the two side folds formed by weld seams can have different lengths and/or shapes.

The two side folds can be arranged symmetrically or asymmetrically.

The vacuum cleaner filter bag can also comprise more than two side folds. In particular, each side fold of the vacuum cleaner filter bag can comprise one or several ones of the properties or features of the at least one side fold described herein.

The bag wall of the vacuum cleaner filter bag can comprise a bag material comprising at least one non-woven layer.

The term non-woven (German "Vliesstoff") is used according to the definition according to ISO Standard ISO09092:1988 or OEM Standard EN29092. In particular, the terms fibrous web or web and non-woven fabric are, in the field of the manufacture of non-woven fabrics, defined, and also to be understood in the sense of the present invention, as follows. For the manufacture of a non-woven, fibers and/or filaments are used. The loose and not yet bonded fibers and/or filaments are referred to as web or fibrous web. By a so-called web bonding step, a non-woven is finally formed from such a fibrous web, the non-woven having sufficient strength to be e.g. reeled up on rollers. In other words, by its consolidation, a non-woven is embodied to be self-supporting. (Details of the use of the definitions and/or methods described herein can also be taken from the standard work "Vliesstoffe", W. Albrecht, H. Fuchs, W. Kittelmann, Wiley-VCH, 2000.)

The non-woven can be a dry- or wet-laid non-woven, or an extrusion non-woven, in particular a meltblown nonwoven or a spunbond filament non-woven ("spunbond"). The delimitation between wet-laid non-wovens and conventional wet-laid paper is made according to the above mentioned definition as it is also used by the International Association Serving the Nonwovens and Related Industries EDANA (www.edana.org). This means, a conventional (filter) paper is no non-woven.

The non-woven can comprise staple fibers or continuous fibers. As to the manufacture, several layers of staple fibers or continuous fibers which are consolidated to form precisely one layer of non-woven can also be provided.

The vacuum cleaner filter bag can in particular be a flat bag. In other words, the vacuum cleaner filter bag is designed such that it does not have a block bottom. Block bottom is defined as a folded bottom whose job usually is to stabilize the filter bag and to form a three-dimensional bag. One example of a block bottom filter bag is known from DE 20 2005 016 309.

The vacuum cleaner filter bag can in particular be a disposable vacuum cleaner bag.

The vacuum cleaner filter bag can comprise a straight weld which is designed to be flat or vertical. The straight weld can be formed, as a consequence of the formation of the vacuum cleaner filter bag, as a tubular bag. In particular, the straight weld can connect two edges of a filter material web from which the tubular bag was formed. The straight weld can in particular be embodied or extend perpendicular to the two transverse weld seams which close the ends of the tubular bag. The vacuum cleaner filter bag can in particular comprise exactly one straight weld.

In case of a flat or horizontal straight weld, the borders of the filter material layer are welded to overlap in a direction perpendicular to the surface of the vacuum cleaner filter bag. In case of a vertical straight weld, the borders are welded to overlap in a direction parallel to the surface of the vacuum cleaner filter bag.

The straight weld can be in particular welded by spin welding.

The vacuum cleaner filter bag can moreover have a through hole, in particular in the bag wall. The through hole can correspond to an admission port through which air to be cleaned flows into the filter bag in the operation of the vacuum cleaner filter bag.

The filter bag can moreover comprise a retaining plate which serves to fix the vacuum cleaner filter bag in a chamber of a vacuum cleaner and which is arranged in the region of the admission port. The retaining plate can in particular be made of plastics. The retaining plate can be connected with the bag wall and comprise a through hole in the region of the admission port.

The admission port and the retaining plate can be positioned on the surface of the bag wall of the vacuum cleaner filter bag as desired. For example, the admission port and the retaining plate can be disposed centrally on the vacuum cleaner filter bag.

The admission port, the retaining plate and/or the straight weld can in particular be positioned such that the air jet or free jet flowing into the bag hits the straight weld. In other words, the straight weld can extend or be disposed opposite the admission port. By this, the bag wall of the vacuum cleaner filter bag can be at least partially protected from damages by particles contained in the air flow.

In particular, the width of a horizontal or flat straight weld can be between 1 and 3 cm, in particular between 1.5 and 3 cm, or between 2 and 3 cm. By this, an advantageous protection of the bag wall of the vacuum cleaner filter bag from damages by particles contained in the air flow can be achieved. The straight weld can in particular be formed by a plurality of weld points. So, the horizontal weld seam then does not correspond to a continuous foil.

The invention moreover provides a method of manufacturing a vacuum cleaner filter bag, in particular a vacuum cleaner filter bag as described above, with at least one side fold formed by two fold legs, comprising the steps of:

- providing a filter material layer,
- forming a tube from the filter material layer, comprising welding a straight weld,
- welding weld lines that will form edges of the at least one side fold,
- stamping out filter material for forming the edges of the at least one side fold,
- welding transverse weld seams for closing an upper and lower ends of the tube,
- turning in the at least one side fold, and
- separating the vacuum cleaner filter bag in the region of the transverse weld seams.

In this manner, a vacuum cleaner filter bag, in particular a flat bag, with a side fold that can be turned out can be manufactured in a simple and inexpensive manner. In particular, by the formation as a tubular bag, additional efforts for double unwinding, continuous path control, welding and changing the reel, which become necessary when a vacuum cleaner filter bag is formed from an upper web and a lower web circumferentially welded at the border, can be eliminated.

In particular, two side folds, in particular at opposite sides of the vacuum cleaner filter bag, can be formed.

The straight weld can be welded by spin welding. In this case, the sonotrode and the anvil can have a wheel-like or annular design, whereby the material to be welded is pulled through between the sonotrode and the anvil. Thus, continuous, that means uninterrupted, welding is possible.

The straight weld can be embodied as vertical or horizontal weld seam.

Welding the straight weld, the transverse weld seams and/or the weld seams of the at least one side fold can include ultrasonic welding and/or thermal welding.

The shape of the stamp-out and the corresponding welding of the weld lines can be trapezoidal, in particular with different angles, U-shaped or semicircular. By this, the shape and/or the length of the edges of the at least one side fold formed by weld seams can be determined. By this, an adaptation to the installation space of the vacuum cleaner is possible.

Further features and advantages of the invention will be described below with reference to the exemplary figures. In the drawing.

Figure 1:
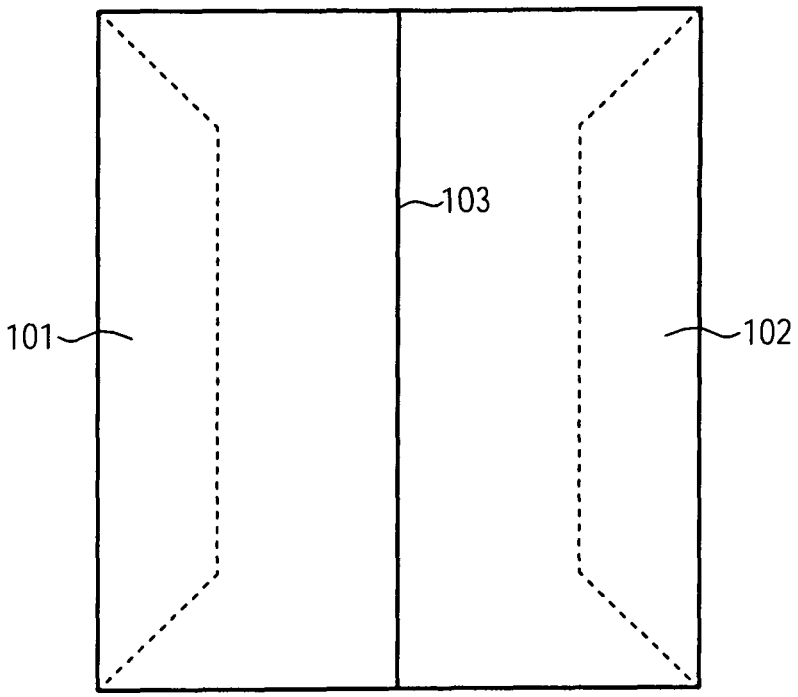
FIG. 1 shows an exemplary vacuum cleaner filter bag in a turned-in state of two side folds.

FIG. 1 schematically shows a plan view onto an exemplary vacuum cleaner filter bag. The exemplary vacuum cleaner filter bag has a rectangular design and comprises two side folds 101 and 102 each formed by two fold legs. The two side folds are here shown in a folded-in or turned-in state. In this state, the vacuum cleaner filter bag can be easily inserted into a vacuum cleaner.

Moreover, this state allows for a small pack size and an easy unfolding of the vacuum cleaner filter bag in the operation of the vacuum cleaner.

When the vacuum cleaner filter bag is introduced into a vacuum cleaner and exposed therein to a flow of air to be cleaned, the side folds 101 and 102, respectively, can be turned to the outside and thereby enlarge the available volume in particular by the pressure differential between the interior and exterior of the vacuum cleaner filter bag in the vacuum cleaner housing.

FIG. 1 moreover shows a straight weld 103. The latter is formed by the embodiment of the vacuum cleaner filter bag as a tubular bag. For the manufacture of the exemplary filter bag, a filter material layer is in particular shaped into a tube, and the edges of the filter material layer are connected, in particular by welding, along the straight weld 103.

The filter material layer can in particular comprise one or several non-woven layers. To obtain the desired properties in view of filtration efficiency, dust storage capacity (capacity) and mechanical strength, different non-woven layers can be combined. The different non-woven layers can be interconnected. The layers can be connected, for example, by gluing, welding (calendering) or needling.

Figure 2:
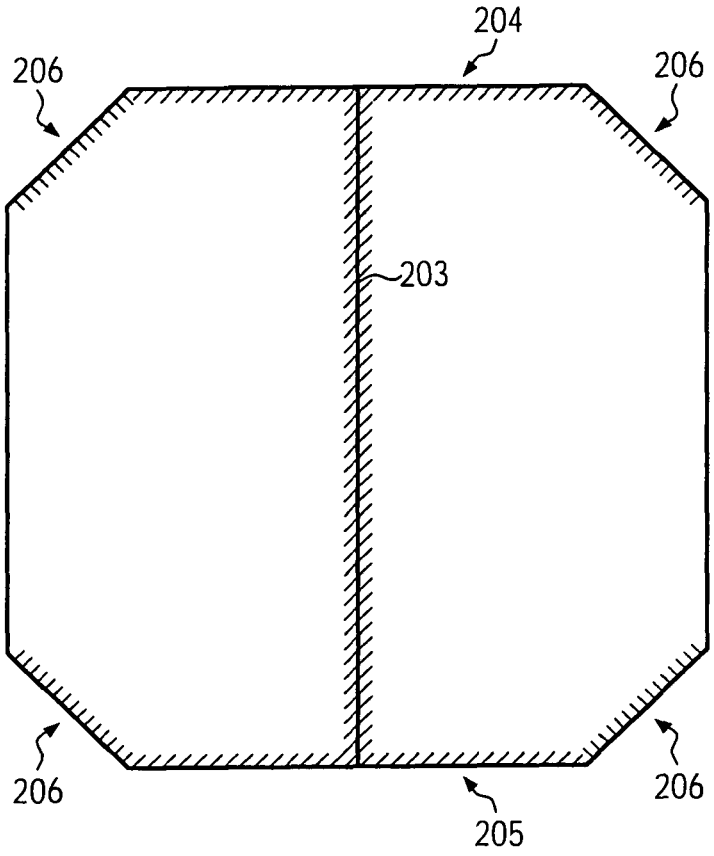
FIG. 2 shows an exemplary vacuum cleaner filter bag in a turned-out state of two side folds.

FIG. 2 shows an exemplary vacuum cleaner filter bag in a folded-out or turned-out state of the side folds. The vacuum cleaner filter bag can be in this state, for example, in the operation of a vacuum cleaner.

FIG. 2 in particular shows, apart from a straight weld 203, also weld seams which, being transverse weld seams 204 and 205, close the upper and lower ends, respectively, of the vacuum cleaner filter bag designed as a tubular bag.

The designations straight or transverse, respectively, relate to the making direction in the production of the vacuum cleaner filter bag. The straight weld 203 here extends perpendicularly to the two transverse weld seams 204 and 205. The welded joints are indicated in this figure by section lines.

Moreover, FIG. 2 shows edges 206 of the side fold formed by weld seams. In particular, two opposed edges of the side folds each are formed by weld seams. The side in-between is not formed by a weld seam but, for example, by a fold line. By this, the side folds can be better folded out, and the bag can be better adapted to the shape of the vacuum cleaner.

In FIG. 2, the edges 206 of the side folds formed by weld seams are each adjacent to one of the transverse weld seams 204 or 205, respectively, that means they are connected at one end with the respective transverse weld seam. The edges 206 formed by weld seams, however, are not connected with the rest of the bag wall, in particular inside the vacuum cleaner filter bag. By this, the side folds can be turned out with the edges 206 formed by weld seams, that means they can be turned out completely.

Figure 3:
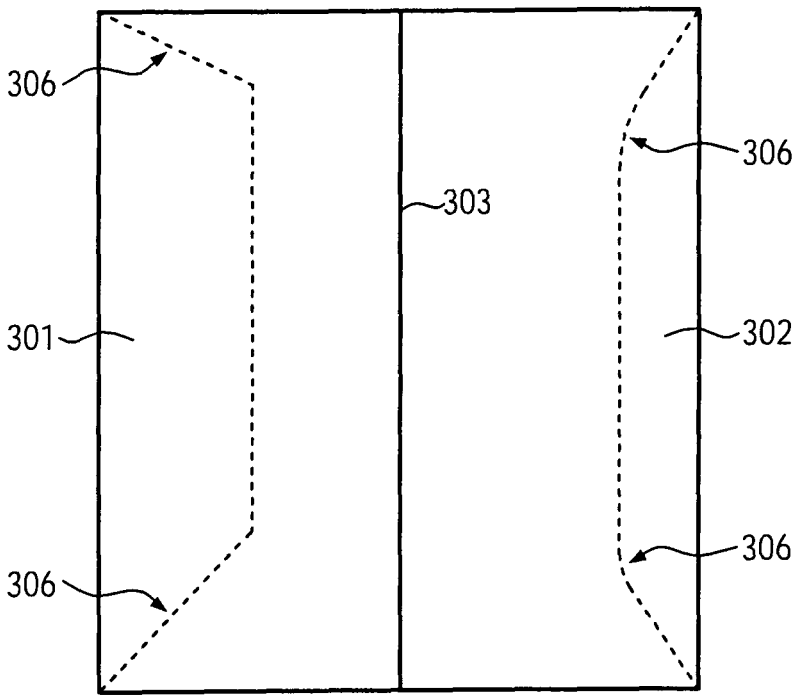
FIG. 3 shows a further exemplary vacuum cleaner filter bag in a turned-in state of two side folds.

FIG. 3 schematically shows a further exemplary vacuum cleaner filter bag in a plan view. Here, two non-identical side folds 301 and 302 are shown. In particular, a first side fold 301 projects deeper into the interior of the bag than a second side fold 302.

Moreover, the four edges 306 of the side folds 301 and 302 formed by weld seams 306 have different designs. For example, the edges 306 of the first side fold 301 formed by weld seams have different lengths, while the edges 306 of the second side fold 302 formed by weld seams are curved in different ways. This means, the edges 306 formed by weld seams differ from each other within one side fold 301, 302 as well as from the edges 306 of the other side fold 301, 302 formed by weld seams.

The edges 306 formed by weld seams, however, can also be embodied with the same lengths and/or geometries in one or two side folds 301, 302.

While the straight weld 303 is here, by way of example, shown to be centered on the vacuum cleaner filter bag, the straight weld 303 can also be positioned in another way. In particular, the straight weld 303 can be positioned in a region of the vacuum cleaner filter bag, in particular in a region of the bag wall of the vacuum cleaner filter bag, which does not form a side fold of the vacuum cleaner filter bag.

Figure 4:
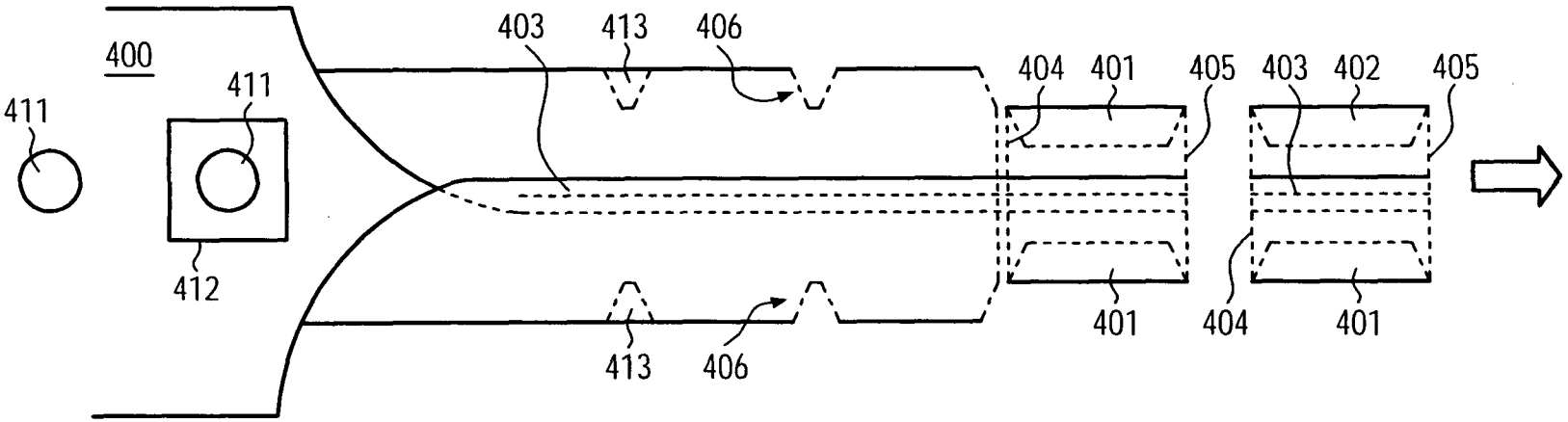
FIG. 4 shows an illustration of a method of manufacturing a vacuum cleaner filter bag.

FIG. 4 illustrates a method of manufacturing an above-described exemplary vacuum cleaner filter bag.

Here, a filter material layer 400 is provided into which first a through hole 411 is punched that forms, in the finished vacuum cleaner filter bag, an admission port for the suction air to be cleaned. In a next step, a retaining plate 412 for arranging the vacuum cleaner filter bag in the vacuum cleaner is applied in the region of the through hole 411.

Then, the filter material layer 400 is shaped into a tube, where opposite borders of the filter material layer 400 are welded by a straight weld 403 extending in the making direction.

Then, weld lines are formed for later forming edges of the side folds 401 and 402 to be formed. Filter material located in the region 413 is then stamped out to form edges 406 of the side folds 401, 402 formed by weld seams.

Then, transverse weld seams 404 and 405 are welded transverse to the making direction, and the side folds 401 and 402 are folded in or turned in.

Finally, the vacuum cleaner filter bag is separated off in the region of the transverse weld seams 404 and 405, respectively.

The welding of the straight weld 403 can in particular be done by spin welding.

The cuttings shown in FIG. 4 are trapezoidal. However, the cuttings can also have any other shape, for example U-shaped, semicircular, or trapezoidal with arbitrary, predetermined angles. By this, the shape of the side folds, in particular in a turned-out or folded-out state, can be determined and adapted to the geometry of the installation space of the vacuum cleaner.

The arrow in FIG. 4 shows the machine direction to which the terms "straight" and "transverse" refer.

Figure 5:
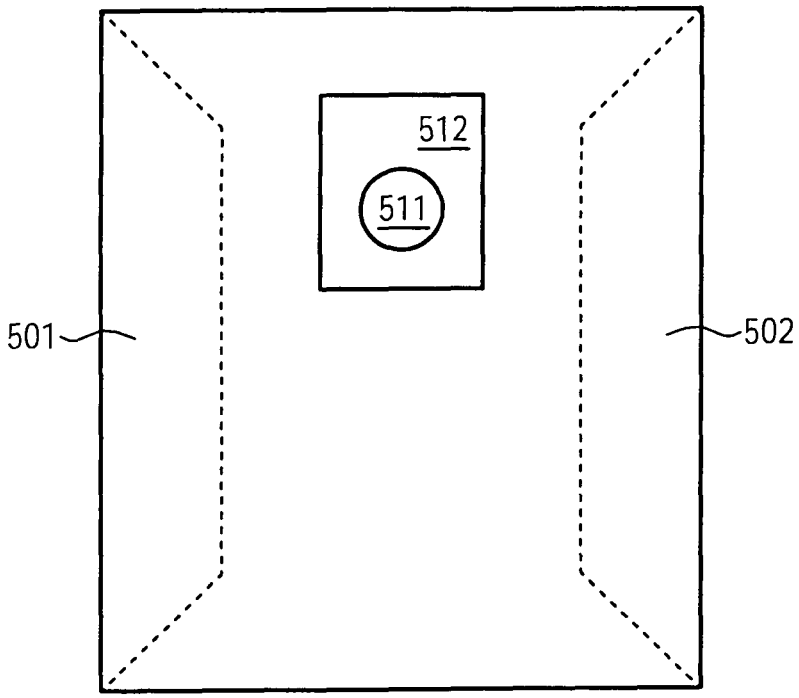
FIG. 5 shows an exemplary vacuum cleaner filter bag with an admission port and a retaining plate.

FIG. 5 illustratively shows a plan view onto a vacuum cleaner filter bag with a through hole 511 as an admission port and a retaining plate 512 arranged in the region of the admission port. Moreover, the vacuum cleaner filter bag comprises two side folds 501 and 502.

In FIG. 5, the through hole 511 and the retaining plate 512 are shown in the upper half of the vacuum cleaner filter bag. The through hole 511 and the retaining plate 512, however, can also be positioned at another site of the vacuum cleaner filter bag, for example centrally.

The through hole can be arranged, for example, such that the air jet or free jet entering through the through hole 511 strikes on the firm and air-tight straight weld. In particular, the straight weld can be embodied to be flat (horizontal) and have a width of for example 2 cm. The straight weld can be in particular formed by a plurality of weld points which are in particular uniformly distributed. By this, the bag wall of the vacuum cleaner filter bag can be protected from damages.

The exemplary plan view shown in FIG. 5 might show, for example, a front wall of a vacuum cleaner filter bag, while FIGS. 1 to 3 represent, for example, back walls.

It will be understood that features mentioned in the above described embodiments are not restricted to these special combinations and are also possible in any other combinations. In particular, the side folds can be embodied with different geometries and dimensions. The vacuum cleaner filter bag might also have only one or more than two side folds. The vacuum cleaner filter bag can be embodied with different geometries and dimensions.

The invention claimed is:

1. A vacuum cleaner filter bag with at least one side fold formed by two fold legs, wherein the at least one side fold comprises, in a turned-in state, at least three edges, two of the edges being formed by one weld seam each, wherein the side fold can be turned out with the edges formed by a weld seam; and wherein the vacuum cleaner filter bag comprises a tubular bag, the vacuum cleaner filter bag comprising a bag wall made from a filter material layer, two opposing edges of the filter material layer being joined together to form a tube.

2. The vacuum cleaner filter bag according to claim 1, wherein the edges formed by weld seams have a straight or curved design.

3. The vacuum cleaner filter bag according to claim 1, wherein the edges formed by weld seams have different lengths.

4. The vacuum cleaner filter bag according to claim 1, wherein two sides comprising opposite sides of the vacuum cleaner filter bag are formed by transverse weld seams, and wherein the edges of the at least one side fold formed by weld seams include, in a turned-in state, each an angle greater than 0° and smaller than 90° with the transverse weld seams.

5. The vacuum cleaner filter bag according to claim 1, wherein an edge of the at least one side fold is formed by a fold line.

6. The vacuum cleaner filter bag according to claim 1, wherein the vacuum cleaner filter bag comprises two side folds.

7. The vacuum cleaner filter bag according to claim 6, wherein the two side folds are designed to be identical or non-identical.

8. The vacuum cleaner filter bag according to claim 1, wherein the vacuum cleaner filter bag comprises a bag wall which comprises a bag material comprising at least one non-woven layer.

9. The vacuum cleaner filter bag according to claim 1, wherein the vacuum cleaner filter bag is a flat bag.

10. A vacuum cleaner filter bag according to claim 1, wherein the vacuum cleaner filter bag comprises a straight weld wherein the straight weld is flat or vertical.

11. A method of manufacturing a vacuum cleaner filter bag with at least one side fold formed by two fold legs, comprising the steps of:

providing a filter material layer, forming a tube from the filter material layer, comprising joining together two opposing edges of the filter material layer to form the tube and welding a straight weld, welding weld lines that will form edges of the at least one side fold, stamping out filter material for forming the edges of the at least one side fold;

welding transverse weld seams for closing an upper and lower ends of the tube, turning in the at least one side fold; and separating off the vacuum cleaner filter bag in the region of the transverse weld seams.

12. The method according to claim 11, wherein the straight weld is welded by spin welding.

13. The method according to claim 11, wherein the straight weld comprises a vertical or horizontal weld seam.

14. The vacuum cleaner filter bag according to claim 1, wherein two sides comprising opposite sides of the vacuum cleaner filter bag are formed by transverse weld seams, and wherein the edges of the at least one side fold formed by weld seams include, in a turned-in state, each an angle greater than 20° and smaller than 70°.

15. The vacuum cleaner filter bag according to claim 6, wherein the two side folds are at opposite sides of the vacuum cleaner filter bag.

* * * * *